US010294940B2

(12) United States Patent
Hirayama et al.

(10) Patent No.: US 10,294,940 B2
(45) Date of Patent: May 21, 2019

(54) ROTARY COMPRESSOR AND REFRIGERATING CYCLE DEVICE

(71) Applicant: TOSHIBA CARRIER CORPORATION, Kawasaki-shi, Kanagawa-ken (JP)

(72) Inventors: Takuya Hirayama, Shizuoka-ken (JP); Motoshi Kikugawa, Shizuoka-ken (JP); Shougo Shida, Shizuoka-ken (JP); Keiichi Hasegawa, Shizuoka-ken (JP)

(73) Assignee: TOSHIBA CARRIER CORPORATION, Kawasaki-Shi (JP)

( * ) Notice: Subject to any disclaimer, the term of this patent is extended or adjusted under 35 U.S.C. 154(b) by 0 days.

(21) Appl. No.: 15/873,989

(22) Filed: Jan. 18, 2018

(65) Prior Publication Data

US 2018/0156216 A1 Jun. 7, 2018

Related U.S. Application Data

(63) Continuation of application No. PCT/JP2016/070946, filed on Jul. 15, 2016.

(30) Foreign Application Priority Data

Sep. 28, 2015 (JP) ..... 2015-189876

(51) Int. Cl.

| | |
|---|---|
| ***F04C 18/356*** | (2006.01) |
| ***F25B 31/00*** | (2006.01) |
| ***F25B 31/02*** | (2006.01) |
| ***F01C 21/08*** | (2006.01) |
| ***F04C 23/00*** | (2006.01) |

(52) U.S. Cl.

CPC ..... *F04C 18/356* (2013.01); *F01C 21/0845* (2013.01); *F01C 21/0881* (2013.01); *F04C 18/3564* (2013.01); *F04C 23/008* (2013.01); *F25B 31/002* (2013.01); *F25B 31/026* (2013.01); *F04C 2240/30* (2013.01); *F04C 2240/40* (2013.01)

(58) Field of Classification Search

CPC .... F25B 31/002; F25B 31/026; F04C 18/356; F04C 18/3564; F04C 2240/30; F04C 2240/40; F04C 23/008

See application file for complete search history.

(56) References Cited

FOREIGN PATENT DOCUMENTS

| | | |
|---|---|---|
| CN | 203374488 | 1/2014 |
| CN | 203463285 | 3/2014 |

(Continued)

OTHER PUBLICATIONS

International Search Report for International Patent Application No. PCT/JP2016/070946 dated Oct. 18, 2016, 4 pages.

*Primary Examiner* — Filip Zec

(74) *Attorney, Agent, or Firm* — Amin, Turocy & Watson LLP

(57) ABSTRACT

A rotary compressor has a blade which is provided in a cylinder so that reciprocating movement can be performed. The blade partitions a cylinder chamber into a suction chamber and a compression chamber by making a tip end portion of the blade contact the outer peripheral surface of a roller. The blade includes two blade members provided so as to be superimposed in an axial direction of a rotary shaft. Tip end portions of the two blade members are made to contact the outer peripheral surface of the roller. The two blade members are energized by a coil spring so that superimposed portions of the blade members are made in contact.

18 Claims, 5 Drawing Sheets

(56) References Cited

FOREIGN PATENT DOCUMENTS

| | | |
|---|---|---|
| JP | 62-132454 | 3/1989 |
| JP | 4-191491 | 7/1992 |
| JP | 2014-034940 | 2/2014 |

ROTARY COMPRESSOR AND REFRIGERATING CYCLE DEVICE

CROSS-REFERENCE TO RELATED APPLICATIONS

This application is a Continuation of PCT international application No. PCT/JP2016/070946 filed on Jul. 15, 2016; the entire contents of which are incorporated herein by reference.

This application is based upon and claims the benefit of priority from the prior Japanese Patent Application No. 2015-189876, filed on Sep. 28, 2015, the entire contents of which are incorporated herein by reference.

FIELD

Embodiments of the invention relates to a rotary compressor which compresses working fluid such as gas refrigerant and to a refrigerating cycle device including a rotary compressor.

BACKGROUND

Conventionally, a rotary compressor, which houses an electric motor portion and a compression mechanism portion that is driven by a rotary shaft connected with the electric motor portion in a hermetic case, partitions a cylinder chamber in the compression mechanism portion into a suction chamber and a compression chamber with a blade and compresses working fluid such as gas refrigerant, is known, with reference to JP2014-034940. In the rotary compressor, the blade includes two blade members which are provided so as to be superimposed in an axial direction of the rotary shaft, and the two blade members are energized by a coil spring so that the two blade members is made to contact the outer peripheral surface of a roller which rotates eccentrically in a cylinder chamber.

However, in the rotary compressor mentioned in the patent document, there is a case to cause a situation, in which a gap is created at a superimposed part of the two blade members and compressed working fluid in the compression chamber leaks from the gap into the suction chamber to lower compression performance.

Further, when jumping of the blade members is caused by liquid compression etc., there is a possibility to cause a situation in which the two blade members perform jumping discretely and move away from the coil spring to damage a compression mechanism portion.

DETAILED DESCRIPTION

A rotary compressor according to an embodiment houses an electric motor portion and a compression mechanism portion which is driven via a rotary shaft provided at the electric motor portion, in a hermetic case. The compression mechanism portion comprises a cylinder having both ends covered with covering members and including a cylinder chamber inside, a roller which is fitted to the rotary shaft and rotates eccentrically in the cylinder chamber, and a blade which is provided in the cylinder so that reciprocating movement can be performed, and partitions the cylinder chamber into a suction chamber and a compression chamber by making a tip end portion of the blade contact the outer peripheral surface of the roller. The rotary compressor compressing working fluid. The blade includes two blade members provided so as to be superimposed in an axial direction of the rotary shaft. Tip end portions of the two blade members are made to contact the outer peripheral surface of the roller. The two blade members are energized by a coil spring so that superimposed portions of the blade members are made in contact.

A refrigerating cycle device according to an embodiment comprises a rotary compressor mentioned above, a heat radiator connected to the rotary compressor, an expansion device connected to the heat radiator, and an evaporator connected between the expansion device and the rotary compressor.

Figure 1:
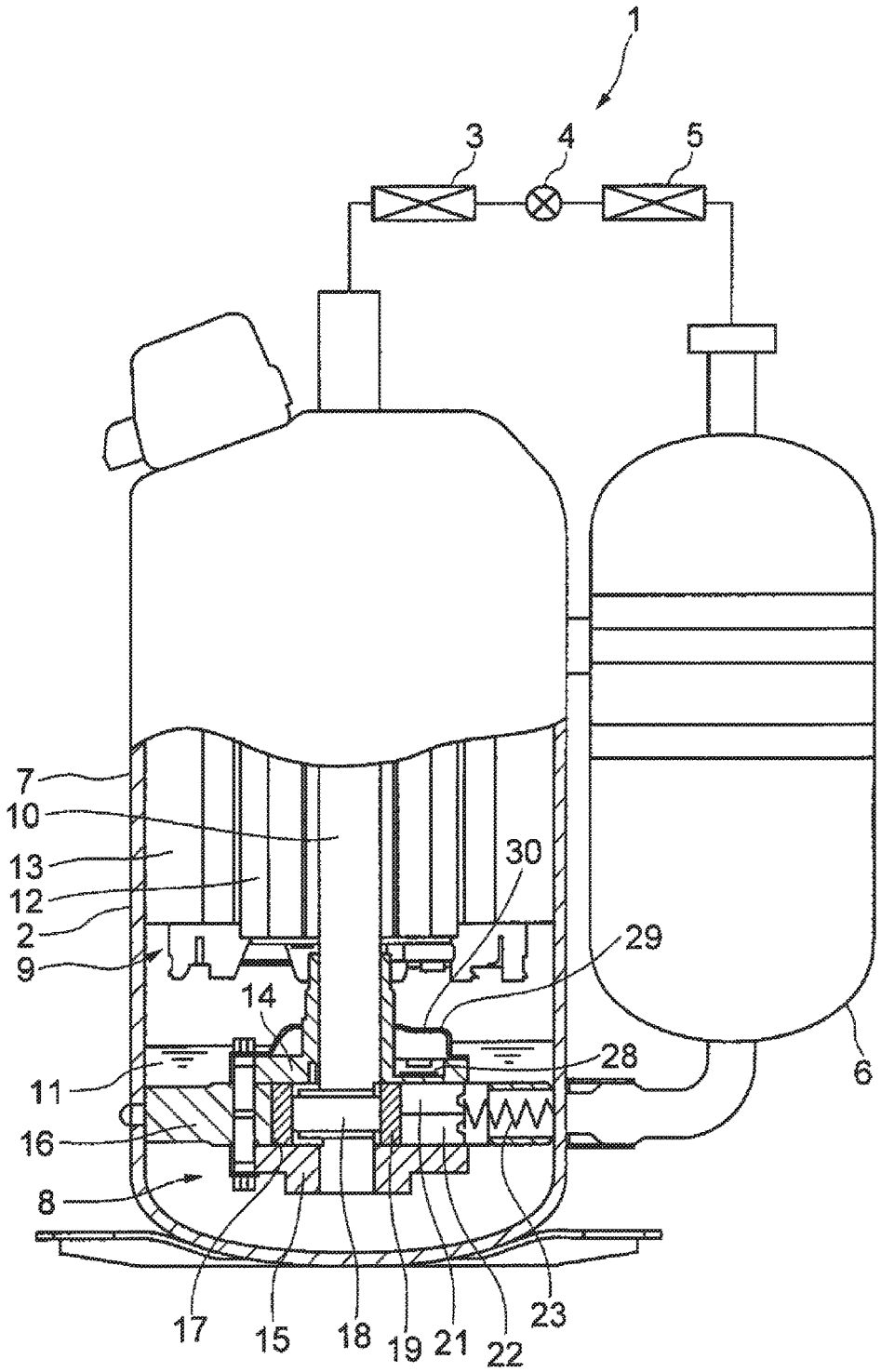
FIG. 1 is a configuration view of the refrigerating cycle device of a first embodiment which contains a rotary compressor shown partly in section.

Hereinafter, further embodiments will be described. A first embodiment will be described with reference to FIGS. 1 to 6. FIG. 1 shows a refrigerating cycle device 1. The refrigerating cycle device 1 includes a rotary compressor 2, a heat radiator 3 connected to the rotary compressor 2, an expansion device 4 connected to the heat radiator 3, an evaporator 5 connected to the expansion device 4, and an accumulator 6 connected to the evaporator 5. The accumulator 6 is connected to the rotary compressor 2.

A gas refrigerant which is a working fluid is compressed to become high temperature and high pressure in the rotary compressor 2, and heat is radiated from the gas refrigerant of high temperature and high pressure in the heat radiator 3.

The refrigerant is decompressed in the expansion device 4, and a decompressed liquid refrigerant is evaporated to become a gas refrigerant in the evaporator 5.

In the accumulator 6, a liquid refrigerant included in the gas refrigerant is separated, and only the gas refrigerant is supplied to the rotary compressor 2.

According to the refrigerating cycle device 1, a refrigerant is circulated, while phase-changing to a gas refrigerant and a liquid refrigerant, heat dissipation and heat absorption are performed in the process, and room heating, room cooling, heating-up, cooling-down etc. are performed using these heat dissipation and heat absorption.

The rotary compressor 2 has a hermetic case 7 which is formed in a cylindrical shape approximately and is made in an air-sealed state. The hermetic case 7 houses a compression mechanism portion 8 which is a portion for compressing a gas refrigerant, and an electric motor portion 9 which is a portion for driving the compression mechanism portion 8, inside. A rotary shaft 10 is provided at the electric motor portion 9. The compression mechanism portion 8 is driven by the electric motor portion 9 via the rotary shaft 10. A lubricating oil 11 is received in a bottom portion of the hermetic case 7.

The electric motor portion 9 is provided with a rotor 12 fixed to the rotary shaft 10, and a stator 13 which is fixed to an inner periphery of the hermetic case 7 and arranged at a position surrounding the rotor 12. A permanent magnet (not shown in the figure) is provided at the rotor 12, and a coil for use of flowing current (not shown in the figure) is wound at the stator 13. The rotary shaft 10 is supported rotatably around a center line by a main bearing 14 located between the electric motor portion 9 and the compression mechanism portion 8 and by a sub-bearing 15 located at a side opposite to the main bearing 14 with the compression mechanism portion 8 sandwiched.

The compression mechanism portion 8 has a cylinder 16 having both ends in an up-and-down direction which are open, a main bearing 14 which serves as a covering member to cover an opening portion at an upper end side of the cylinder 16, and a sub-bearing 15 which serves as a covering member to cover an opening portion at a lower end side of the cylinder 16. A cylinder chamber 17 is provided in an interior of the cylinder 16 by covering the both ends of the cylinder 16 by means of the main bearing 14 and the sub-bearing 15. The rotary shaft 10 is inserted in the cylinder chamber 17. An eccentric portion 18 is provided at a portion of the rotary shaft 10 located in the cylinder chamber 17. A roller 19 is fitted into the eccentric portion 18. The roller 19 is provided so as to rotate eccentrically in the cylinder chamber 17 with rotation of the rotary shaft 10.

Figure 2:
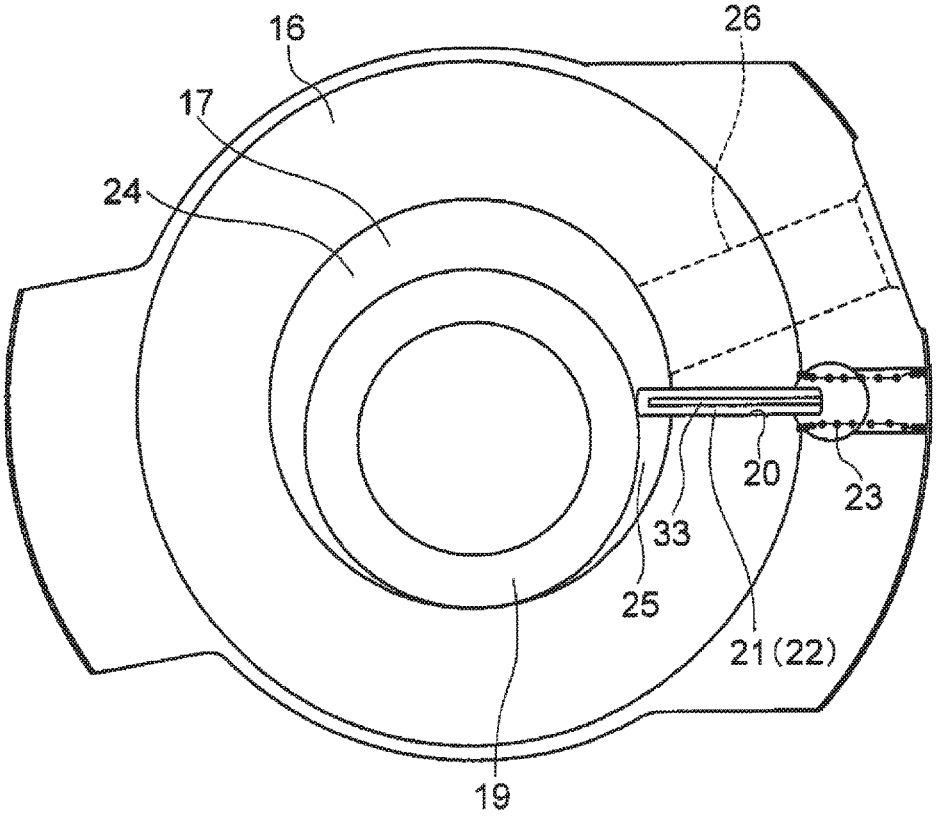
FIG. 2 is a horizontally cut view showing a compression mechanism portion.

As shown in FIG. 2, a blade groove 20 is provided in the cylinder 16. Two blade members 21, 22 are inserted in the blade groove 20 so that reciprocating movement can be performed. The two blade members 21, 22 are provided so as to be superimposed in an axial direction of the rotary shaft 10 as shown in FIG. 1. Tip end portions of the blade members 21, 22 contact the outer peripheral surface of the roller 19. A coil spring 23 which energizes the blade members 21, 22 is arranged at back end sides of the blade members 21, 22.

As shown in FIG. 2, the interior of the cylinder chamber 17 is partitioned into a suction chamber 24 and a compression chamber 25 by making the tip end portions of the blade members 21, 22 contact the outer peripheral surface of the roller 19. A suction passage 26 through which the gas refrigerant to be sucked into the suction chamber 24 flows is provided in the cylinder 16.

Returning to FIG. 1, the main bearing 14 is provided with a discharge hole (not shown in the figure) which discharges the gas refrigerant compressed in the compression chamber 25. Further, the main bearing 14*a* is provided with a discharge valve 28 for opening and closing the discharge hole and a discharge muffler 29 for covering the discharge hole and the discharge valve 28. A communicating hole 30 for making the interior of the discharge muffler 29 communicate with the interior of the hermetic case 7 is formed in the discharge muffler 29.

Figure 3:
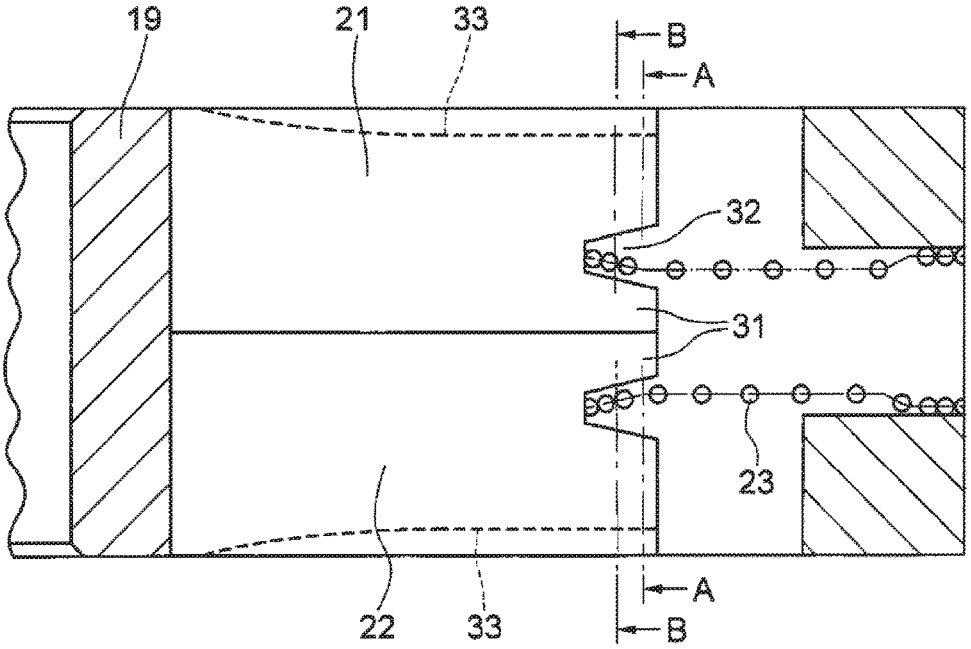
FIG. 3 is an enlarged front view showing a mounted state of blade members and a coil spring.

The shapes and the mounted states of the blade members 21, 22 and the coil spring 23 will be explained. As shown in FIG. 3, trapezoid projecting portions 31 are provided at one end sides of rear end portions of the blade members 21, 22. These projecting portions 31 are provided so as to be superimposed in the axial direction of the rotary shaft 10. The two projecting portions 31 in a superimposed state are fitted inside the coil spring 23.

Figure 4:
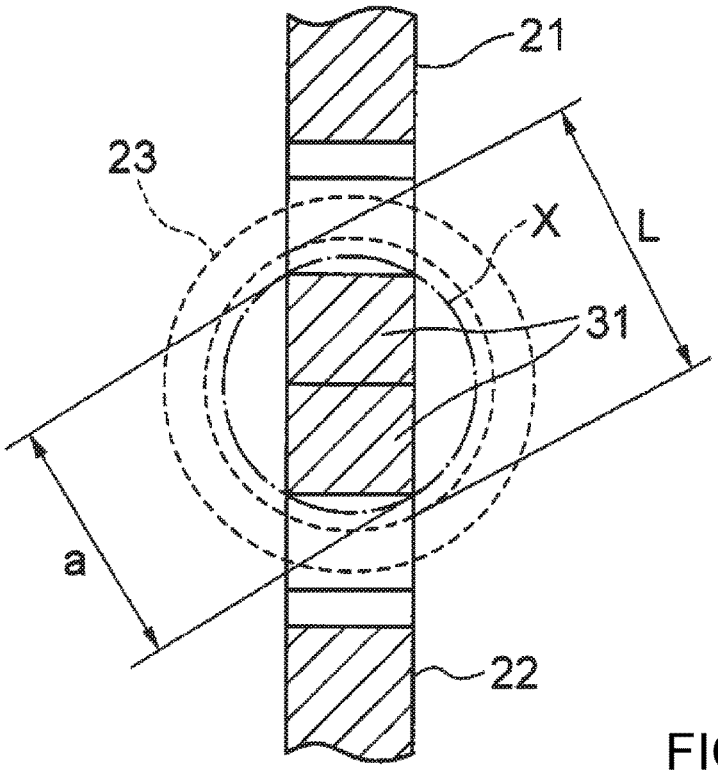
FIG. 4 is a sectional view of an A-A line in FIG. 3.
Figure 5:
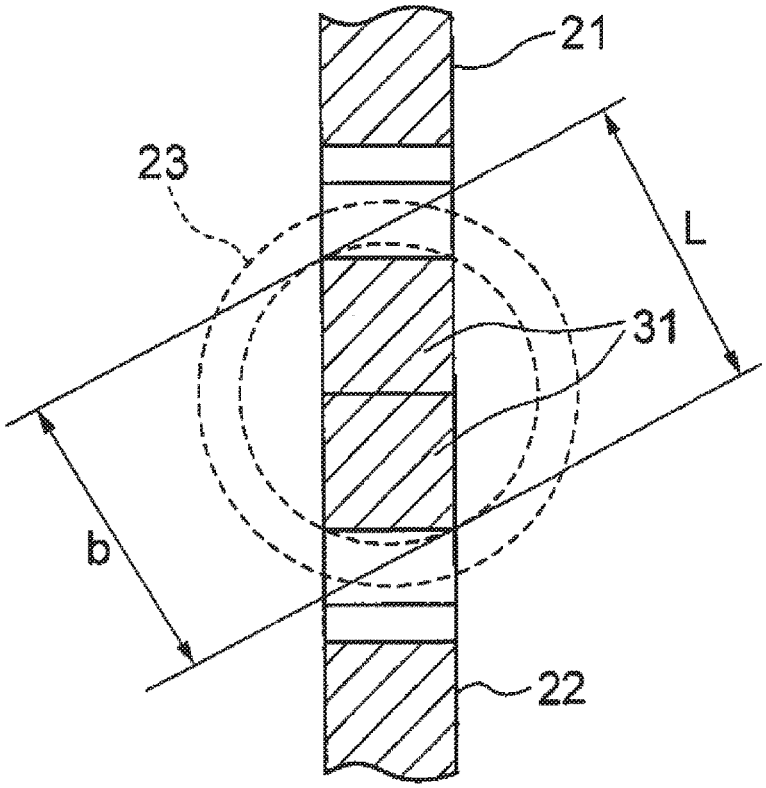
FIG. 5 is a sectional view of a B-B line in FIG. 3.

The diameter of a circumscribed circle of a section of the two projecting portions 31 in the superimposed state in a direction perpendicular to a blade reciprocating movement direction is set as follows. As shown in FIG. 4, at a place of a section of an A-A line of FIG. 3 which is at back end sides of the projecting portions 31 in the blade reciprocating movement direction, the diameter "a" of the circumscribed circle X of the section is formed smaller than the dimension "L" of the inner diameter of the coil spring 23. The diameter of the circumscribed circle of the section of the two projecting portions 31 in a direction perpendicular to the blade reciprocating movement direction is formed so that the diameter becomes large gradually, as is directed to a tip end side in the blade reciprocating movement direction. As shown in FIG. 5, at a place of a section of a B-B line in FIG. 3, the diameter "b" of the circumscribed circle of the section is formed as the same as the dimension "L" of the inner diameter of the coil spring 23. Further, at a place closer to the tip end side in the blade reciprocating movement direction than the place of the B-B section of FIG. 3, the diameter of the circumscribed circle of the section of the two projecting portions 31 in the direction perpendicular to the blade reciprocating movement direction is formed larger than the dimension "L" of the inner diameter of the coil spring 23.

At a tip end portion of the coil spring 23, a solid coiling portion 32 which is made solid in a coiling state is provided. The solid coiling portion 32 is contacted with the peripheral portion of the projecting portions 31.

As shown in FIGS. 2 and 3, oil supplying slots 33 are formed at a surface of the blade member 21 opposite to the main bearing 14 and at a surface of the blade member 22 opposite to the sub-bearing 15. These oil supplying slots 33 have one ends extending to rear end portions of the blade members 21, 22 and immersed in a lubricating oil 11 in the hermetic case 7, and have the other ends extended positions of which are formed not to reach tip end portions of the blade members 21, 22. The one ends of the oil supplying slots 33 is formed to be positioned in the cylinder chamber 17, even when the blade members 21, 22 project to the cylinder chamber 17 most. The other end sides of the oil supplying slots 33 are formed in a circular arc shape which has a slot depth which becomes shallow gradually as is directed to the other ends.

Figure 6:
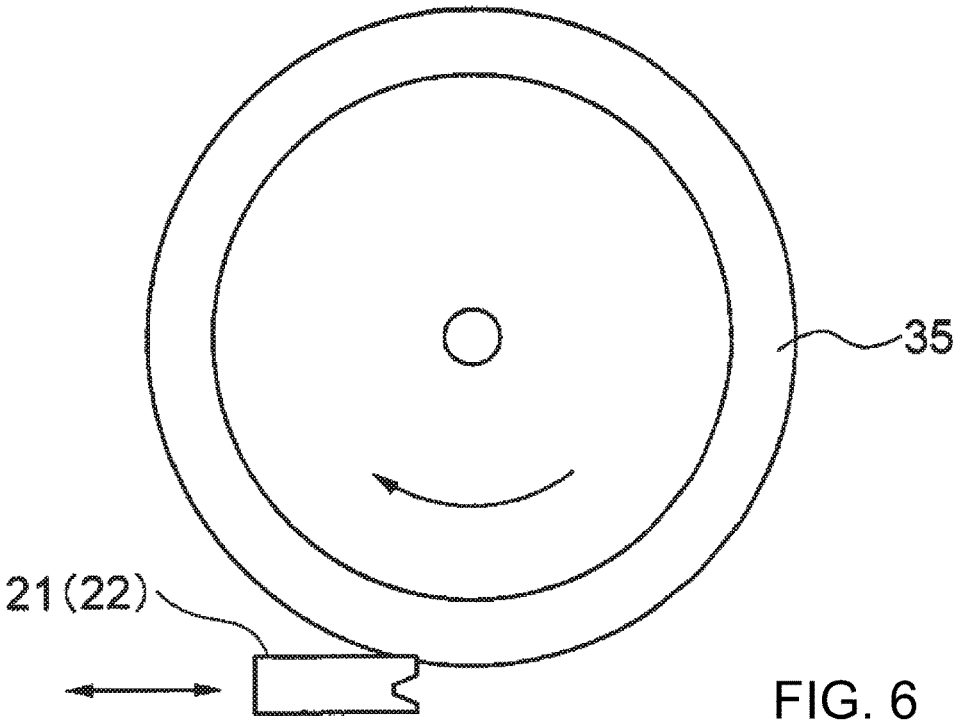
FIG. 6 is an explanatory view for explaining a working process to form an oil supplying slot in a blade member.

FIG. 6 is an explanatory view showing a process for forming the oil supplying slots 33. Oil supplying slots 33 of blade members 21, 22 are formed by applying slot processing to a central portion of a surface opposite to a main bearing 14 and a sub-bearing 15 by means of a disk cutter 35 under rotating.

In such a configuration, in the rotary compressor 2, the rotary shaft 10 rotates around the center line by flowing current through the electric motor portion 9, the compression mechanism portion 8 is driven by rotation of the rotary shaft 10, and the gas refrigerant is compressed in the compression mechanism portion 8.

The discharge valve 28 is opened when the pressure of the compressed gas refrigerant reaches a predetermined pressure, and the compressed gas refrigerant is discharged from the discharge hole 27 into the discharge muffler 29. The gas refrigerant of high-pressure which is discharged into the discharge muffler 29 passes through the communicating hole 30 and flows into the hermetic case 7, and the interior of the hermetic case 7 is filled with the gas refrigerant of high-pressure. A refrigerating cycle is performed by circulating the gas refrigerant of high-pressure in the hermetic case 7 via the heat radiator 3, the expansion device 4 and the evaporator 5 in the order to the rotary compressor 2 again.

In the compression mechanism portion 8, the tip end portions of the blade members 21, 22 energized by the coil spring 23 are contacted with the outer peripheral surface of the roller 19 which rotates eccentrically, and the interior of the cylinder chamber 17 is partitioned into the suction chamber 24 and the compression chamber 25. By eccentric rotation of the roller 19, the gas refrigerant is sucked into the suction chamber 24 from the suction passage 26 and the sucked gas refrigerant is compressed in the compression chamber 25.

The blade members 21, 22 are provided so as to be superimposed in the axial direction of the rotary shaft 10, and a pressing force which acts against the outer peripheral surface of the roller 19 from each of the blade member 21, 22 is reduced by half compared with a case where a blade of a form which unifies blade members 21, 22 is used. Thus, when part of tip end portions of the blade members 21, 22 contacts the outer peripheral surface of the roller 19, i.e., a state of one-side contact occurs, a planar pressure between the tip end portions of the blade members 21, 22 and the outer peripheral surface of the roller 19 is reduced, and anomalous attrition of the blade members 21, 22 and burn-in are suppressed.

In addition, the projecting portions 31 are provided at one end sides of the rear end portions of the blade members 21, 22. These projecting portions 31 are provided so as to be superimposed in the axial direction of the rotary shaft 10. The projecting portions 31 in a superimposed state are fitted inside the coil spring 23. A diameter of a circumscribed circle of a section of the projecting portions 31 in the superimposed state in a direction perpendicular to a blade reciprocating movement direction is formed larger than an inner diameter dimension of the coil spring 23, at a place at the tip end side in the blade reciprocating movement direction. Thus, a force which is directed to contact the superposed portions of the blade members 21, 22 acts from the coil spring 23 against the blade members 21, 22. Accordingly, occurrence of a gap can be prevented at a superimposed part of the blade members 21, 22, and leakage of gas refrigerant from the gap can be prevented in the cylinder chamber 17. Leakage of gas refrigerant from the compression chamber 25 to the suction chamber 24 can be prevented, and the fall of compression performance of the rotary compressor 2 can be prevented. Further, a force acts against the blade members 21, 22 in a direction which is directed to contact the superposed portions of the blade members 21, 22, and thereby the two blade members can be prevented from performing jumping discretely when jumping of the blade members 21, 22 is caused with liquid compression etc. Accordingly, occurrence of a situation, in which the two blade members 21, 22 move away from the coil spring 23 by discrete jumping of the two blade members 21, 22 and the compression mechanism portion 8 is damaged, can be prevented.

With respect to a work for fitting two projecting portions 31 into the inside of a coil spring 23, at back end sides of the projecting portions 31, as shown in FIG. 4, the diameter "a" of a circumscribed circle X of a section of the two projecting portions 31 is formed smaller than the dimension "L" of the inner diameter of the coil spring 23. Thus, the work for fitting the projecting portions 31 into the inside of the coil spring 23 can be done easily.

The diameter of the circumscribed circle of the section of the two projecting portions 31 is formed large gradually as is directed to the tip end side in the blade reciprocating movement direction, and a portion larger than the dimension "L" of the inner diameter of the coil spring 23 is formed at the tip end side. Accordingly, when the projecting portions 31 are fitted into the inside of the coil spring 23, a tip end portion of the coil spring 23 is broadened in an expansively opening direction and contacts outer peripheral portions of the projecting portions 31. By the configuration, it is possible to give a force which is directed to contact superposed portions of the blade members 21, 22, from the coil spring 23 to the blade members 21, 22, surely.

Further, the solid coiling portion 32 is provided at the tip end portion of the coil spring 23, and the solid coiling portion 32 is contacted with the peripheral portions of the projecting portions 31. Thus, it is possible to maintain the force which acts from the coil spring 23 to the blade members 21, 22 and is directed to contact the superposed portions of the blade members 21, 22, constantly, even when the coil spring 23 expands and contracts with reciprocating movement of the blade members 21, 22.

The oil supplying slots 33 are formed at the surface of the blade member 21 opposite to the main bearing 14 and at the surface of the blade member 22 opposite to the sub-bearing 15. These oil supplying slots 33 have the one ends extending to the rear end portions of the blade members 21, 22 and immersed in the lubricating oil 11. Accordingly, the lubricating oil can be fully supplied to a portion where the blade member 21 and the main bearing 14 are opposed and a portion where the blade member 22 and the sub-bearing 15 are opposed, attrition which is caused by contact of the blade members 21, 22 and the main bearing 14 and the sub-bearing 15 can be prevented, the sealing property between the blade members 21, 22 and the main bearing 14 and the sub-bearing 15 can be raised, and the compression performance of the rotary compressor 2 can be raised.

The extending positions of the other ends of the oil supplying slots 33 are positions which do not to reach the tip end portions of the blade members 21, 22 and are set to be positioned in the cylinder chamber 17 when the blade members 21, 22 project to the cylinder chamber 17 most. Thus, occurrence of shortage of the lubricating oil 11 in the hermetic case 7 with flow of a large amount of the lubricating oil 11 in the hermetic case 7 into the hermetic case 7 can be prevented, and contact portions of the roller 19 and the blade members 21, 22 can be lubricated by flowing a small amount of the lubricating oil 11 into the cylinder chamber 17.

The other end sides of the oil supplying slots 33 are formed in a circular arc shape having a slot depth which becomes shallow gradually as is directed to the other ends. By making the oil supplying slots 33 in such a shape, the lubricating oil can be fully supplied to the portion where the blade member 21 and the main bearing 14 are opposed and the portion where the blade member 22 and the sub-bearing 15 are opposed, and the lubricating oil flowing into the cylinder chamber 17 can be suppressed to be a small amount. As shown in FIG. 6, formation of such oil supplying slots 33 having a circular arc shape at end portions can be performed easily using a rotating disk cutter 35.

Figure 7:
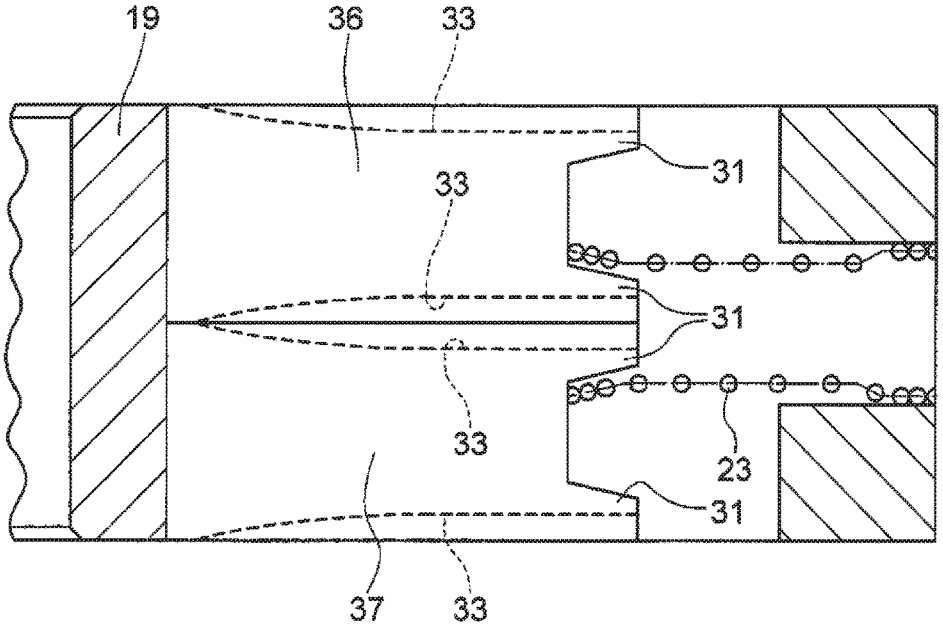
FIG. 7 is an enlarged front view showing a mounted state of blade members and a coil spring in a second embodiment.

A second embodiment will be described based on FIG. 7. The same reference sign will be assigned to the same configuration element as is explained in the first embodiment, and repetition of explanation will be omitted.

The second embodiment differs from the first embodiment in a configuration using blade members 36 and 37 in place of the blade members 21, 22, and the other configurations are same as those of the first embodiment. In the blade members 21, 22, the projecting portions 31 are provided only at one end sides of the rear end portions of the blade members 21, 22, but, in the blade members 36 and 37, projecting portions 31 of the same shape are provided at both end sides of rear end portions of the blade members 36 and 37.

Further, in the blade members 21, 22, the oil supplying slots 33 are formed only at one surfaces opposite to the main bearing 14 and the sub-bearing 15, but, in the blade members 36 and 37, oil supplying slots 33 are formed at surfaces opposite to the main bearing 14 and the sub-bearing 15 and at surfaces on the opposite sides.

In such a configuration, since the projecting portions 31 of the same shape are provided at the both end sides of the rear end portions of the blade members 36 and 37, when the two blade members 36 and 37 are superimposed, it is possible to superimpose the blade members 36 and 37 without taking the positional relationship of the blade members 36 and 37 in an up-and-down direction into consideration and to raise working efficiency at the time of superimposing the blade members 36 and 37.

Since the oil supplying slots 33 are respectively formed at the surfaces opposite to the main bearing 14 and the sub-bearing 15 and at the surfaces on the opposite sides, it is possible to make the oil supplying slots 33 oppose to the main bearing 14 and the sub-bearing 15 and to supply the lubricating oil 11 using the oil supplying slots 33, when superimposition of the blade members 36 and 37 is performed without taking the positional relationship of the blade members 36 and 37 in an up-and-down direction into consideration.

While certain embodiments of the invention have been described above, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A rotary compressor compressing working fluid which houses an electric motor portion and a compression mechanism portion that is driven via a rotary shaft provided at the electric motor portion, in a hermetic case, the compression mechanism portion comprising:

a cylinder having both ends covered with covering members and having a cylinder chamber inside;

a roller which is fitted to the rotary shaft and rotates eccentrically in the cylinder chamber; and a blade which is provided in the cylinder so that reciprocating movement can be performed and partitions the cylinder chamber into a suction chamber and a compression chamber by making a tip end portion of the blade contact the outer peripheral surface of the roller, wherein the blade includes two blade members are provided so as to be superimposed in an axial direction of the rotary shaft, tip end portions of the two blade members are made to contact the outer peripheral surface of the roller, and the two blade members are energized by a coil spring so that superimposed portions of the blade members are made in contact.

2. The rotary compressor according to claim 1, wherein a rear end portion of each blade member is provided with a projecting portion, the projecting portion of each blade member is provided so as to be superimposed in the axial direction of the rotary shaft, the two projecting portions are fitted inside the coil spring in a superimposed state, and a diameter of a circumscribed circle of a section of the two projecting portions in the superimposed state in a direction perpendicular to a blade reciprocating movement direction is formed smaller than a dimension of a inner diameter of the coil spring at back end sides of the projecting portions in the blade reciprocating movement direction, is formed large gradually as is directed to a tip end side in the blade reciprocating movement direction, and includes a portion formed larger than the dimension of the inner diameter of the coil spring.

3. The rotary compressor according to claim 1, wherein a solid coiling portion is provided at a tip end portion of the coil spring and that energization to the blade members by the coil spring is performed at the solid coiling portion.

4. The rotary compressor according to claim 1, wherein an oil supplying slot is provided at a surface of each blade member opposite at least to the covering member, the oil supplying slot extends along the blade reciprocating movement direction, one end of the oil supplying slot extends to the rear end portion of the blade member, the other end of the oil supplying slot does not reach the tip end portion of the blade member, the other end of the oil supplying slot is located in the cylinder chamber when the blade member projects most in the cylinder chamber, and a slot depth of the oil supplying slot at the other end side becomes shallower gradually as is directed to the other end.

5. The rotary compressor according to claim 2, wherein a solid coiling portion is provided at a tip end portion of the coil spring and that energization to the blade members by the coil spring is performed at the solid coiling portion.

6. The rotary compressor according to claim 2, wherein an oil supplying slot is provided at a surface of each blade member opposite at least to the covering member, the oil supplying slot extends along the blade reciprocating movement direction, one end of the oil supplying slot extends to the rear end portion of the blade member, the other end of the oil supplying slot does not reach the tip end portion of the blade member, the other end of the oil supplying slot is located in the cylinder chamber when the blade member projects most in the cylinder chamber, and a slot depth of the oil supplying slot at the other end side becomes shallower gradually as is directed to the other end.

7. The rotary compressor according to claim 3, wherein an oil supplying slot is provided at a surface of each blade member opposite at least to the covering member, the oil supplying slot extends along the blade reciprocating movement direction, one end of the oil supplying slot extends to the rear end portion of the blade member, the other end of the oil supplying slot does not reach the tip end portion of the blade member, the other end of the oil supplying slot is located in the cylinder chamber when the blade member projects most in the cylinder chamber, and a slot depth of the oil supplying slot at the other end side becomes shallower gradually as is directed to the other end.

8. The rotary compressor according to claim 4, wherein the other end side of the supplying slot is formed in a circular arc shape so that the slot depth becomes shallower gradually as is directed to the other end.

9. The rotary compressor according to claim 7, wherein the other end side of the supplying slot is formed in a circular arc shape so that the slot depth becomes shallower gradually as is directed to the other end.

10. A refrigerating cycle device, comprising:

the rotary compressor according to claim 1;

a heat radiator connected to the rotary compressor;

an expansion device connected to the heat radiator; and an evaporator connected between the expansion device and the rotary compressor.

11. The refrigerating cycle device according to claim 10, wherein in the rotary compressor, a rear end portion of each blade member is provided with a projecting portion, the projecting portion of each blade member is provided so as to be superimposed in the axial direction of the rotary shaft, the two projecting portions are fitted inside the coil spring in a superimposed state, and a diameter of a circumscribed circle of a section of the two projecting portions in the superimposed state in a direction perpendicular to a blade reciprocating movement direction is formed smaller than a dimension of a inner diameter of the coil spring at back end sides of the projecting portions in the blade reciprocating movement direction, is formed large gradually as is directed to a tip end side in the blade reciprocating movement direction, and includes a portion formed larger than the dimension of the inner diameter of the coil spring.

12. The refrigerating cycle device according to claim 10, wherein in the rotary compressor, a solid coiling portion is provided at a tip end portion of the coil spring and that energization to the blade members by the coil spring is performed at the solid coiling portion.

13. The refrigerating cycle device according to claim 10, wherein in the rotary compressor, an oil supplying slot is provided at a surface of each blade member opposite at least to the covering member, the oil supplying slot extends along the blade reciprocating movement direction, one end of the oil supplying slot extends to the rear end portion of the blade member, the other end of the oil supplying slot does not reach the tip end portion of the blade member, the other end of the oil supplying slot is located in the cylinder chamber when the blade member projects most in the cylinder chamber, and a slot depth of the oil supplying slot at the other end side becomes shallower gradually as is directed to the other end.

14. The refrigerating cycle device according to claim 11, wherein a solid coiling portion is provided at a tip end portion of the coil spring and that energization to the blade members by the coil spring is performed at the solid coiling portion.

15. The refrigerating cycle device according to claim 11, wherein an oil supplying slot is provided at a surface of each blade member opposite at least to the covering member, the oil supplying slot extends along the blade reciprocating movement direction, one end of the oil supplying slot extends to the rear end portion of the blade member, the other end of the oil supplying slot does not reach the tip end portion of the blade member, the other end of the oil supplying slot is located in the cylinder chamber when the blade member projects most in the cylinder chamber, and a slot depth of the oil supplying slot at the other end side becomes shallower gradually as is directed to the other end.

16. The refrigerating cycle device according to claim 12, wherein an oil supplying slot is provided at a surface of each blade member opposite at least to the covering member, the oil supplying slot extends along the blade reciprocating movement direction, one end of the oil supplying slot extends to the rear end portion of the blade member, the other end of the oil supplying slot does not reach the tip end portion of the blade member, the other end of the oil supplying slot is located in the cylinder chamber when the blade member projects most in the cylinder chamber, and a slot depth of the oil supplying slot at the other end side becomes shallower gradually as is directed to the other end.

17. The refrigerating cycle device according to claim 13, wherein the other end side of the supplying slot is formed in a circular arc shape so that the slot depth becomes shallower gradually as is directed to the other end.

18. The refrigerating cycle device according to claim 16, wherein the other end side of the supplying slot is formed in a circular arc shape so that the slot depth becomes shallower gradually as is directed to the other end.

* * * * *